US006174176B1

(12) United States Patent
Hong

(10) Patent No.: US 6,174,176 B1
(45) Date of Patent: Jan. 16, 2001

(54) MEMORY CARD CONNECTOR

(75) Inventor: Kwen Ming Hong, Tao-Yuan Hsien (TW)

(73) Assignee: Speed Tech Corp., Tao Yuan Hsien (TW)

( * ) Notice: Under 35 U.S.C. 154(b), the term of this patent shall be extended for 0 days.

(21) Appl. No.: 09/414,016

(22) Filed: Oct. 6, 1999

(30) Foreign Application Priority Data

Dec. 31, 1998 (TW) ..... 87221894

(51) Int. Cl.[7] ..... H01R 4/66
(52) U.S. Cl. ..... 439/92
(58) Field of Search ..... 439/92, 76.1, 74, 439/59, 64, 108

(56) References Cited

U.S. PATENT DOCUMENTS 5,588,850 * 12/1996 Pan et al. ..... 439/92

* cited by examiner

*Primary Examiner*—Gary F. Paumen
*Assistant Examiner*—Phuong Chi Nguyen
(74) *Attorney, Agent, or Firm*—Pro-Techtor International Services

(57) ABSTRACT

A memory card connector installed in a circuit board to receive a memory card, and to connect the received memory card to the circuit board, the memory card connector including a connector body, a set of terminals, and two metal guide bars, wherein the connector body has a terminal holder block, and two arms respectively and perpendicularly formed on two distal ends of the elongated terminal holder block and arranged in parallel, the arms each having a rear end connected to the terminal holder block and a front end terminating into a locating means; the terminals are respectively mounted in the terminal holder block, each having a rear end welded to a respective contact at the circuit board and a front end projecting into the space defined between the arms of the connector body for receiving the inserted memory card; the metal guide bars each have a coupling unit respectively coupled to the locating means at the arms of the connector body, and a grounding unit respectively connected to a grounding circuit at the circuit board for guiding noise signal from the inserted memory card to the grounding circuit at the circuit board.

6 Claims, 3 Drawing Sheets

MEMORY CARD CONNECTOR

BACKGROUND OF THE INVENTION

The present invention relates to a memory card connector, and more particularly to such a memory card connector that has means to protect against electromagnetic interference.

Regular mobile data processing apparatus (for example, palm-top computers, digital cameras), due to size and weight limitations, cannot have many built-in data storage means. In order to eliminate this problem, replaceable memory cards are developed for use with mobile data processing apparatus. For receiving a memory card, a mobile data processing apparatus must be equipped with a memory card connector. The memory card connector is installed in the circuit board of the mobile data processing apparatus. The design of a memory card connector must enable a memory card to be quickly and accurately installed. When a memory card is inserted into the memory card connector at a mobile data processing apparatus, interference electric charges are guided from the memory card through the grounding terminal of the memory card connector to the grounding circuit of the circuit board. Because this arrangement cannot quickly and completely guide out noise signal from the inserted memory card to the circuit board, the signal transmission quality is unstable.

SUMMARY OF THE INVENTION

The present invention has been accomplished to provide a memory card connector, which eliminates the aforesaid problem. It is one object of the present invention to provide a memory card connector, which eliminates static electricity from the inserted memory card. It is another object of the present invention to provide a memory card connector, which enables the inserted memory card to be quickly and accurately guided into position. According to one aspect of the present invention, the memory card connector comprises a connector body, a set of terminals, and two metal guide bars, wherein the connector body comprises a terminal holder block, and two arms respectively and perpendicularly formed on two distal ends of the elongated terminal holder block and arranged in parallel, the arms each having a rear end connected to the terminal holder block and a front end terminating into a locating means; the terminals are respectively mounted in the terminal holder block, each having a rear end welded to a respective contact at the circuit board and a front end projecting into the space defined between the arms of the connector body for receiving the inserted memory card; the metal guide bars each have a coupling unit respectively coupled to the locating means at the arms of the connector body, and a grounding unit respectively connected to a grounding circuit at the circuit board for guiding noise signal from the inserted memory card to the grounding circuit at the circuit board. According to another aspect of the present invention, the locating means of each of the arms of the connector body comprises a plug hole, and the coupling unit of each of the metal guide arms comprises a plug strip plugged into the plug hole of the locating means at the corresponding arm. According to still another aspect of the present invention, the locating means of each of the arms of the connector body further comprises a rectangular locating rod axially extended from the corresponding arm at the connector body adjacent to the corresponding plug hole, and the metal guide arms are hollow members respectively sleeved onto the locating rod of the locating means of each of the arms of the connector body. According to still another aspect of the present invention, the grounding unit of each of the metal guide bars comprises a springy contact strip for contacting metal shell means of the inserted memory card, and a mounting lug connected between the springy contact strip and the grounding circuit of the circuit board for guiding noise signal from the inserted memory card to the grounding circuit of the circuit board.

DETAILED DESCRIPTION OF THE PREFERRED EMBODIMENT

Figure 1:
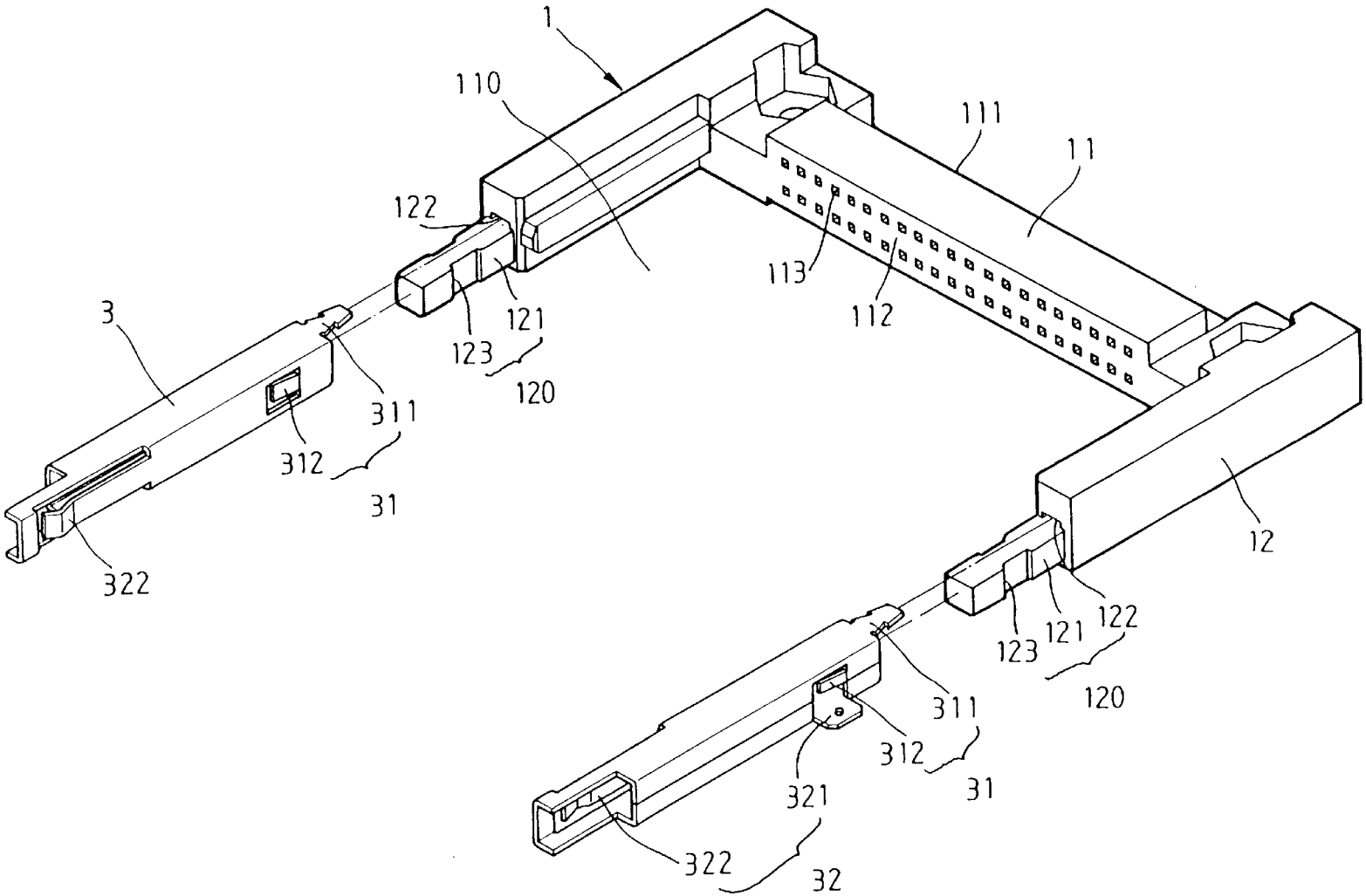
FIG. 1 is an exploded view of a memory card connector according to the present invention.
Figure 2:
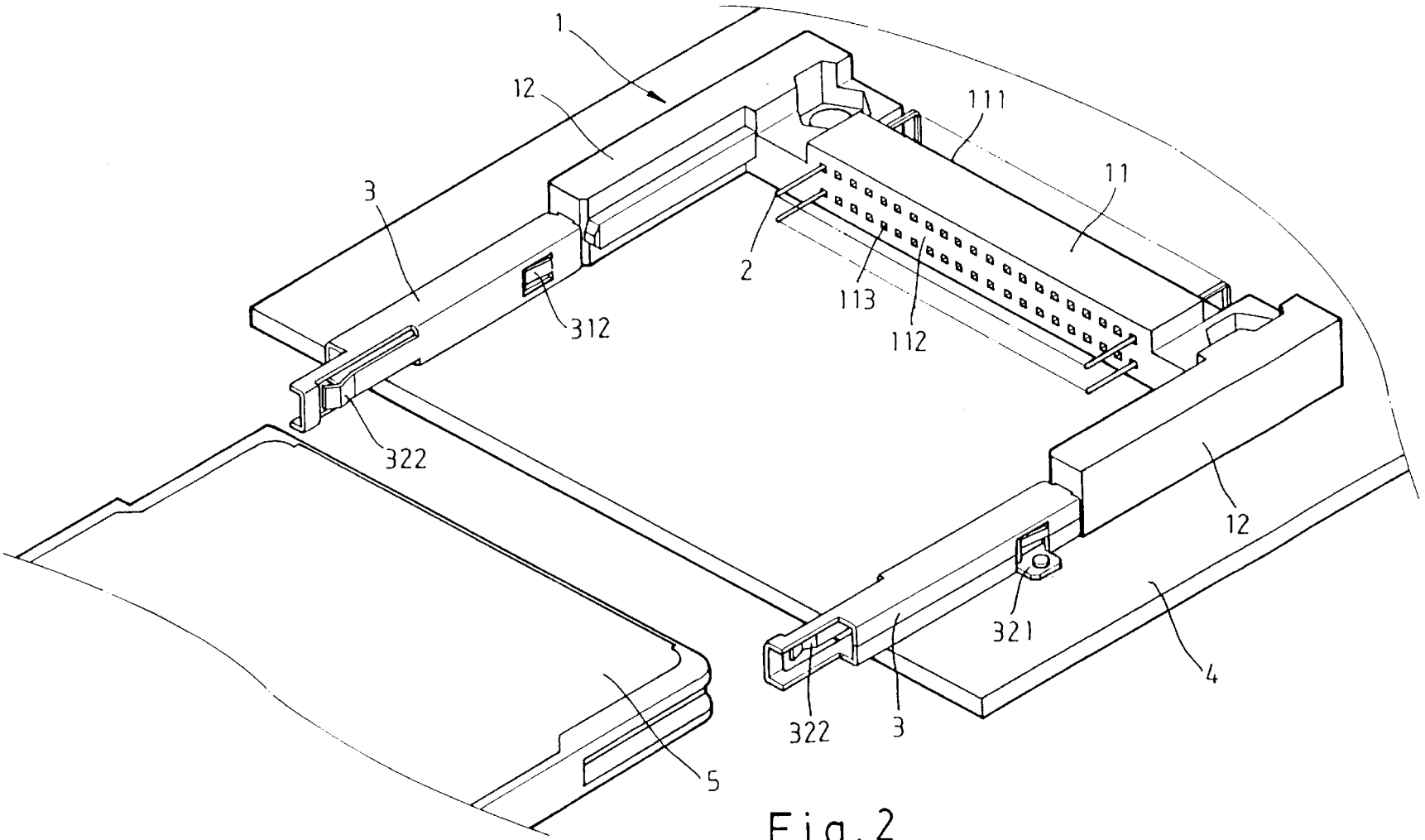
FIG. 2 illustrates the memory card connector installed in a circuit board according to the present invention.

Referring to FIGS. 1 and 2, a memory card connector is shown comprised of a connector body 1, a set of terminals 2, and two metal guide bars 3.

The connector body 1 comprises an elongated terminal holder block 11, and two arms 12 respectively and perpendicularly formed on two distal ends of the elongated terminal holder block 11 and arranged in parallel. The terminal holder block 11 and the arms 12 define a receiving space 110. The terminal holder block 11 comprises a back side wall 111, a front side wall 112, and two longitudinal rows of terminal holes 113 arranged in parallel at different elevations through the back side wall 111 and the front side wall 112 for holding the terminals 2. The terminals 2 are respectively mounted in the terminal holes 113 at the terminal holder block 11, each having a front end protruding from the front side wall 112 into the receiving space 110 for plugging into a respective contact hole (not shown) at a memory card 5, and a rear end extended out of the back side wall 111 and welded to a respective contact (not shown) at a circuit board 4 (see FIG. 2). The arms 12 each have a fixed rear end connected to the terminal holder block 11, and a free front end terminating in a locating means 120. The locating means 120 comprises a rectangular locating rod 121 axially extended from the corresponding arm 12, a plug hole 122 at the free front end of the corresponding arm 12 adjacent to the top side wall of the locating rod 121, and two recessed retaining portions 123 at two opposite lateral side walls of the locating rod 121. The metal guide bars 3 are rectangular hollow members respectively sleeved onto the locating rods 121 of the locating means 120 at the arms 12 of the connector body 1. Each metal guide bar 3 comprises a coupling unit 31, and a grounding unit 32. The coupling unit 31 comprises a serrated plug strip 311 for plugging into the plug hole 122 of the locating means 120 at the corresponding arm 12 at the connector body 1, and two retainer strips 312 for engaging the two recessed retaining portions 123 at two opposite lateral side walls of the locating rod 121 of the locating means 120 at the corresponding arm 12 at the connector body 1. The grounding unit 32 comprises a springy contact strip 322 facing the receiving space 110, and a mounting lug 321 for fastening to the circuit board 4.

Figure 3:
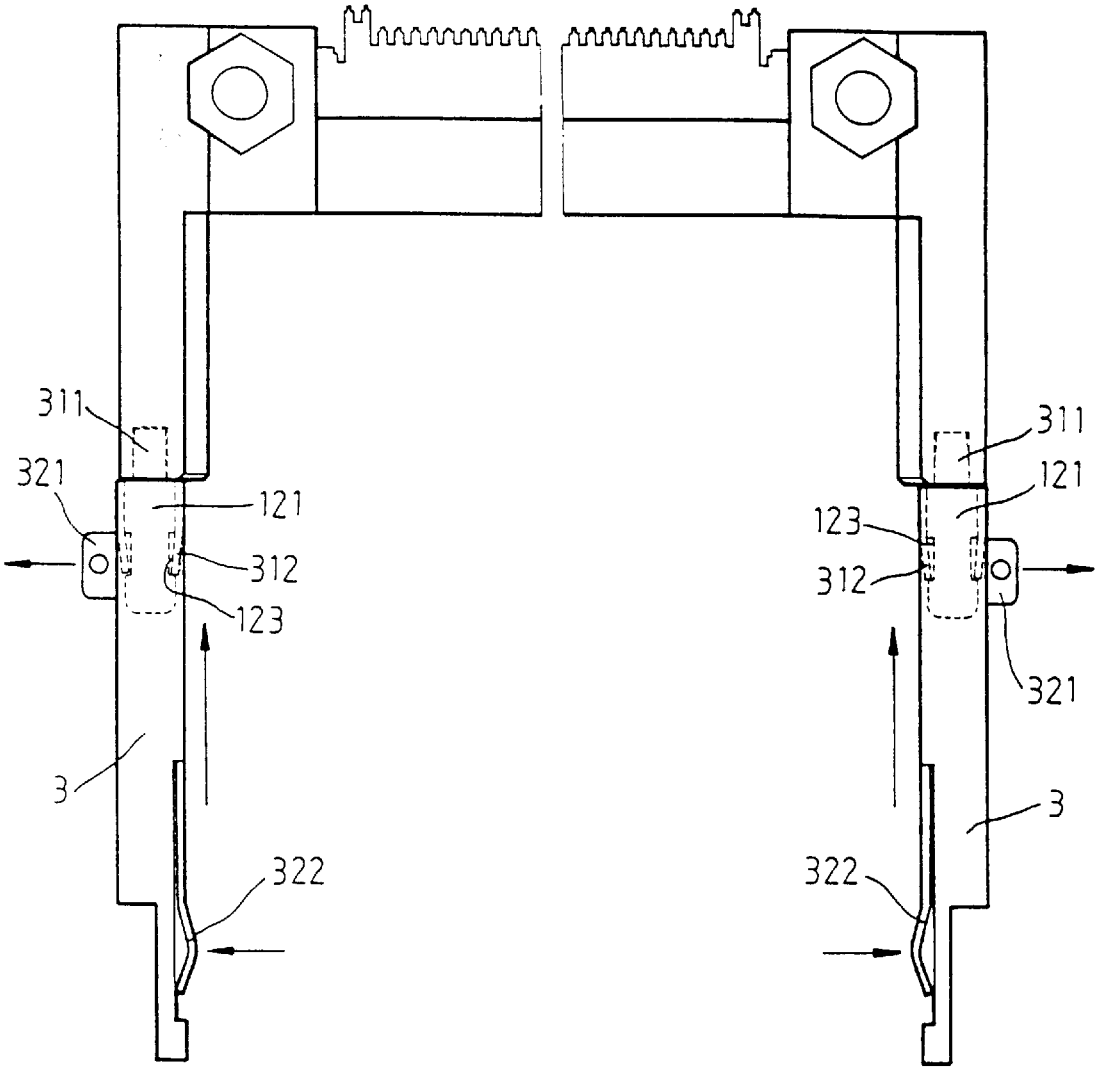
FIG. 3 is a top plain view of the present invention, showing the noise signal guide path.

Referring to FIG. 3 and FIGS. 1 and 2 again, the metal guide bars 3 are respectively sleeved onto the locating rods 121 of the locating means 120 at the arms 12 of the connector body 1, enabling the serrated plug strip 311 of each metal guide bar 3 to be respectively plugged into the plug hole 122 of the locating means 120 at each of the arms 12 of the connector body 1, and the retainer strips 312 of each metal guide bar 3 to be respectively forced into engagement with the recessed retaining portions 123 at the locating rod 121 of the locating means 120 of each of the arms 12 of the connector body 1. After connection of the metal guide bars 3 to the connector body 1, the mounting lugs 321 of the metal guide bars 3 are respectively and fixedly fastened to the circuit board 4 and connected to the grounding circuit of the circuit board 4.

Figure 4:
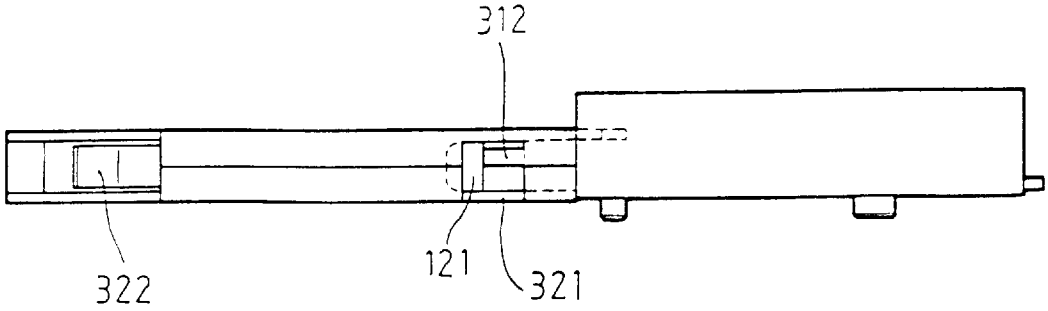
FIG. 4 is a sectional view of a part of the present invention.

Referring to FIG. 4 and FIGS. 2 and 3 again, when a memory card 5 is inserted into the receiving space 110 within the connector body 1 and electrically connected to the terminals 2 at the terminal holder block 11, the two opposite lateral side walls of the metal shell of the memory card 5 are respectively forced into contact with the springy contact strips 322 of the metal guide bars 3, enabling produced noise signal to be guided through the springy contact strips 322 and lugs 321 to the grounding circuit of the circuit board 4. Therefore, the memory card effectively eliminates an electromagnetic interference.

While only one embodiment of the present invention has been shown and described, it will be understood that various modifications and changes could be made thereunto without departing from the spirit and scope of the invention disclosed.

What the invention claimed is:

1. A memory card connector installed in a circuit board to receive a memory card, and to connect the received memory card to the circuit board, the memory card connector comprising:

a connector body, said connector body comprising an elongated terminal holder block, two arms formed on two distal ends of said elongated terminal holder block and arranged in parallel, a receiving space defined between said arms for receiving the memory card, said arms each having a rear end connected to said terminal holder block and a front end terminating in a locating means;

a plurality of terminals respectively mounted in said terminal holder block and arranged into two parallel rows, said terminals each having a front end projecting into said receiving space and a rear end welded to a respective contact at the circuit board; and two metal guide bars respectively coupled to the locating means at said arms of said connector body for guiding the inserted memory card into contact with said terminals, said metal guide bars each comprising a hollow compartment of a coupling unit at a rear end thereof, said coupling unit receiving in said hollow compartment a corresponding one of said locating means of said connector body such that said hollow compartment surrounds said locating means, and a grounding unit respectively connected to a grounding circuit at the circuit board for guiding signal noise from the inserted memory card to the grounding circuit at the circuit board.

2. The memory card connector of claim 1 wherein the grounding unit of each of said metal guide bars comprises a springy contact strip facing said receiving space, said contact strip contacts a metal shell means of the inserted memory card, said metal guide bars further include a mounting lug connected between said springy contact strip and the grounding circuit of the circuit board for guiding signal noise from the inserted memory card to the grounding circuit of the circuit board.

3. The memory card connector of claim 1 wherein the locating means of each of said arms of said connector body comprises a plug hole, and the coupling unit of each of said metal guide arms comprises a plug strip that is inserted into the plug hole of the locating means of the corresponding arm.

4. The memory card connector of claim 3 wherein the locating means of each of said arms of said connector body further comprises a rectangular locating rod axially extended from the corresponding arm at said connector body adjacent to the corresponding plug hole, and said hollow compartments of said metal guide arms are respectively sleeved onto the locating rod of the locating means of each of said arms of said connector body.

5. The memory card connector of claim 4 wherein the plug strip of the coupling unit of each of said metal guide arms is a serrated strip.

6. The memory card connector of claim 5 wherein the locating means of each of said arms of said connector body further comprises two recessed retaining portions at two opposite lateral side walls of the locating rod thereof, and the coupling unit of each of said metal guide bars comprises two retainer strips respectively forced into engagement with the recessed retaining portions at two opposite lateral side walls of the locating rod of the locating means at the corresponding arm at said connector body.

* * * * *